US007897012B2

(12) United States Patent
Takaoka et al.

(10) Patent No.: US 7,897,012 B2
(45) Date of Patent: Mar. 1, 2011

(54) SHEET CONTAINING FIBROUS OR TUBULAR MOISTURE ADSORBENT METAL OXIDE

(75) Inventors: Kazuchiyo Takaoka, Tokyo (JP); Masanobu Matsuoka, Tokyo (JP); Masatoshi Kito, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 174 days.

(21) Appl. No.: 12/309,039

(22) PCT Filed: Jul. 4, 2007

(86) PCT No.: PCT/JP2007/063768

§ 371 (c)(1),
(2), (4) Date: May 13, 2009

(87) PCT Pub. No.: WO2008/004703

PCT Pub. Date: Jan. 10, 2008

(65) Prior Publication Data

US 2009/0321028 A1 Dec. 31, 2009

(30) Foreign Application Priority Data

Jul. 5, 2006 (JP) ..... 2006-186113

(51) Int. Cl.
*D21H 13/12* (2006.01)
*D21H 13/46* (2006.01)

(52) U.S. Cl. ..... 162/145; 162/146; 162/152; 162/156; 162/157.1; 162/157.2; 55/524; 55/527; 55/528; 442/334; 442/415; 442/416

(58) Field of Classification Search ..... 162/145, 162/146, 152, 157.1, 157.2, 156; 55/524, 55/527, 528; 210/504, 505, 506, 508, 509; 442/334, 415, 416
See application file for complete search history.

(56) References Cited

U.S. PATENT DOCUMENTS

| | | | | |
|---|---|---|---|---|
| 4,973,382 | A * | 11/1990 | Kinn et al. | 162/146 |
| 4,983,193 | A * | 1/1991 | Tani et al. | 55/487 |
| 5,403,444 | A * | 4/1995 | Goettmann et al. | 162/146 |
| 7,582,132 | B2 * | 9/2009 | Jaffee | 55/524 |
| 7,641,764 | B2 * | 1/2010 | Yoshida et al. | 162/125 |
| 2002/0070002 | A1 | 6/2002 | Ohgami et al. | |
| 2006/0160455 | A1 * | 7/2006 | Sugyo et al. | 442/417 |

FOREIGN PATENT DOCUMENTS

| | | |
|---|---|---|
| JP | 59-32921 | 2/1984 |
| JP | 2-80696 | 3/1990 |
| JP | 5-115737 | 5/1993 |
| JP | 6-226037 | 8/1994 |
| JP | 10-212691 | 8/1998 |
| JP | 10-212692 | 8/1998 |
| JP | 11-189999 | 7/1999 |
| JP | 2001-40580 | 2/2001 |
| JP | 2002-4193 | 1/2002 |
| JP | 2004-68188 | 3/2004 |
| JP | 2004-268020 | 9/2004 |
| JP | 2004-346446 | 12/2004 |

OTHER PUBLICATIONS

International Search Report dated Oct. 16, 2007 in the International (PCT) Application PCT/JP2007/063768 of which the present application is the U.S. National Stage.
PCT Written Opinion dated Oct. 16, 2007 in the International (PCT) Application PCT/JP2007/063768 of which the present application is the U.S. National Stage.

* cited by examiner

*Primary Examiner*—Eric Hug
*Assistant Examiner*—Peter Chin
(74) *Attorney, Agent, or Firm*—Wenderoth, Lind & Ponack, L.L.P.

(57) ABSTRACT

This invention is to provide a sheet product that is excellent in moisture absorption amount, moisture absorption speed and moisture release speed and is capable of keeping a powder from falling off and that can have a large content of a moisture adsorbent, and the sheet product of this invention contains (a) a moisture adsorbent formed of a tubular or fibrous metal oxide, (b) a cellulosic fibrillated fiber, and (c) an organic fiber having a fineness of 0.01 dtex to 0.45 dtex and is characteristically produced by a paper-making method.

16 Claims, 1 Drawing Sheet

SHEET CONTAINING FIBROUS OR TUBULAR MOISTURE ADSORBENT METAL OXIDE

TECHNICAL FIELD

This invention relates to a sheet product capable of moisture absorption and moisture release and an article formed of the sheet product.

BACKGROUND ART

For the purpose of maintaining a surrounding environment at a constant relative humidity, a sheet product containing a moisture adsorbent is used as a packing material during storage or transportation of an art object, an electric product, a craft product, clothes, etc., a house interior finishing material, a moisture absorption agent in a closet, etc. Further, a sheet product capable of moisture absorption and moisture release is also used in a dehumidifier in an air-conditioning apparatus or a dehumidifier device for dehumidifying and humidifying air in a room and a total heat exchanger device for ventilating a room while exchanging a temperature (heat) and a humidity (moisture) with each other between air exhaustion and air suction. In the air-conditioning apparatus or the total heat exchanger device, a laminate obtained by stacking corrugated sheet products or a product that is obtained by winding a sheet product in the form of a rotor is used as a dehumidifier device or heat exchanger device.

Conventionally, the moisture adsorbent is selected from organic moisture adsorbents such as a super absorbent polymer, carboxymethyl cellulose, etc., and inorganic moisture adsorbents such as sepiolite, zeolite, bentonite, attapulgite, diatomite, activated carbon, silica gel, aluminum hydroxide, etc. These moisture adsorbents absorb a large amount of moisture. However, they have a problem that they take a time to decrease a relative humidity due to the sluggish speed of moisture absorption. In particular, in an air-conditioning apparatus and a total heat exchanger device, it is required to perform dehumidification for a short period of time for which air is flowing, and it has hence been an important object to improve the speed of moisture absorption.

When a sheet product containing a water absorption agent is used as a packaging material, a water absorption agent in a closet, etc., it is required to make the moisture absorption agent release moisture by drying the sheet product by means of sunlight, etc., under an ordinary temperature environment when it is regenerated. When it is used in an air conditioning apparatus or total heat exchanger device, the sheet product is required to have a large speed of moisture release since it is required to repeat moisture absorption and moisture release for a short period of time or perform moisture permeation in the thickness direction. Since the above moisture adsorbents that have been hitherto frequently used have insufficient speeds of moisture release, sheet products are not fully regenerated, and their moisture absorption capability at an initial stage is sometimes not maintained. They have therefore problem that the time period for moisture release is increased or that an air conditioning apparatus or a total heat exchanger device needs to be increased in size for improving the heating capability for moisture release.

For overcoming these problems, it has been desired to develop a moisture adsorbent that is improved in moisture absorption amount, moisture absorption speed and moisture release speed.

Meanwhile, a sheet product containing a moisture adsorbent is in many cases required to have heat resistance, and hence many sheet products using inorganic fibers are used. As a method for the production thereof, there has been proposed a method in which an inorganic fiber paper is shaped in the form of a honeycomb and it is then calcined at a high temperature to remove an organic substance, followed by impregnation with an application liquid containing a moisture adsorbent and then drying at a high temperature (JP6-226037A), a method in which a ceramic fiber paper is impregnated with water glass to generate silica gel (JP5-115737A), or the like. These sheet products using inorganic fibers have had a problem that since they are hard and fragile, they are poor in impact resistance or susceptible to a large amount of moisture adsorbent powder falling off. In sheet products using inorganic fibers, further, high-temperature calcining is carried out for decreasing a weight, so that not any organic moisture adsorbent can be used. Further, the limitation imposed on the selection of a moisture adsorbent is that even inorganic moisture adsorbents cannot be used if they suffer a change in physical properties such as crystal structure, etc., at a high temperature.

For overcoming the impact resistance and the limitation imposed on the selection of a moisture adsorbent, sheet products comprising a moisture adsorbent and an organic fiber have been proposed. For example, there have been proposed a paper for a total heat-exchanger, which comprises a moisture adsorbent, a fiber for paper making and a thermally fusible substance (JP10-212691A), a paper for a total heat-exchanger, which comprises a moisture adsorbent, a fiber for paper making and cellulose that is converted to microfibril (JP11-189999A), a humidity-adjusting sheet comprising a cellulose fiber and a moisture adsorbent (JP2004-68188A), a substrate comprising a moisture adsorbent and an organic fiber (US Patent Application Publication No. 2002/0070002), and an adsorption element comprising a flame-retarding synthetic pulp, a polyvinyl alcohol-containing binder and a moisture adsorbent (JP2004-268020A). Since these sheet products using organic fibers are broken due to an impact to less degree and involve no high-temperature calcining step, the limitation imposed on the selection of a moisture adsorbent is alleviated. However, there has not yet been completely overcome the problem of a moisture adsorbent powder falling off during the production of an article by corrugating a sheet product or winding a sheet product in the form of a rotor or during the use of a sheet product as a packing material or in an air-conditioning apparatus. In particular, when the content of a moisture adsorbent in a sheet product is increased up to 30 mass % or more for increasing the moisture absorption amount, the amount of a powder that falls off is large. When the content of a moisture adsorbent is increased for preventing a powder from falling off, it is required to increase the amount of a sheet product for attaining an intended relative humidity, which results in a problem of an increase of an air-conditioning apparatus or a total heat exchanger device in size.

DISCLOSURE OF THE INVENTION

It is an object of this invention to provide a sheet product that is excellent in moisture absorption amount, moisture absorption speed and moisture release speed and can keep a powder from falling off and that can also have a high content of a moisture adsorbent. The present inventors have made diligent studies and as a result have found that the above object can be achieved by a sheet product comprising a moisture adsorbent formed of a tubular or fibrous metal oxide, a cellulosic fibrillated fiber and an organic fiber having a fineness of 0.01 to 0.45 dtex, and on the basis of finding of this, the present invention has been completed.

That is, this invention provides:

(1) a sheet product comprising (a) a moisture adsorbent formed of a tubular or fibrous metal oxide, (b) a cellulosic fibrillated fiber, and (c) an organic fiber having a fineness of 0.01 dtex to 0.45 dtex, (2) a sheet product as recited in the above (1), which further comprises (d) a fiber bondable under moisture and heat, (3) a sheet product as recited in the above (2), wherein the component (d) is an ethylene-vinyl alcohol copolymer fiber or a polyvinyl-alcohol-based fiber, (4) a sheet product as recited in the above (1), which further comprises (e) an organic fiber having a fineness of over 0.45 dtex but not more than 2.5 dtex, (5) a sheet product as recited in the above (1), which further comprises (f) a thermally fusible organic fiber having a fineness of over 0.45 dtex but not more than 2.5 dtex, (6) a sheet product as recited in any one of the above (1) to (5), wherein the content of the component (a) based on the sheet product is 30 mass % to 90 mass %, (7) a sheet product as recited in any one of the above (1) to (6), which is produced by a paper-making method, and (8) an article comprising the sheet product recited in any one of the above (1) to (7).

The sheet product of this invention contains a moisture adsorbent formed of a tubular or fibrous metal oxide as a component (a). This moisture adsorbent has a large specific surface area, and the surface thereof has hydrophilic nature, so that a high moisture absorption capability can be attained when the above moisture adsorbent is used. Moreover, the above moisture adsorbent can easily form a structure such as network structure, a structure having the form of balls made of yarns, etc., and the structure positively holds moisture on the surface thereof by means of capillarity. Therefore, the sheet product of this invention containing the above moisture adsorbent is capable of increasing the moisture absorption speed and the moisture release speed and hence performing moisture absorption and release for a short period of time as compared with a sheet product using, as a moisture adsorbent, a structure that adsorbs moisture therein such as a highly water-absorptive polymer, a porous inorganic powder, or the like. Moreover, the tubular or fibrous moisture adsorbent is easily entangled with other fibers constituting the sheet product owing to the above network structure or the structure having the form of balls made of yarns, so that the sheet product having the above tubular or fibrous moisture adsorbent, provided by this invention, can have an increased content of the moisture adsorbent while keeping moisture adsorbent from coming off (powder from falling off) as compared with any conventional sheet product using a spherical or particulate moisture adsorbent.

The sheet product of this invention contains a cellulosic fibrillated fiber as a component (b). This cellulosic fibrillated fiber has a large specific area and is finely divided, so that it is excellent in the property of holding the moisture adsorbent and can increase the content thereof while improving the effect that the moisture adsorbent is kept from coming off (powder from fall off). Further, the cellulosic fibrillated fiber has surface functional groups such as a hydroxyl group, etc., and hence has a high affinity for the tubular or fibrous moisture adsorbent having high hydrophilic nature. In this point, the content of the moisture adsorbent in the sheet product of this invention can be also increased while improving the effect that the moisture adsorbent is kept from coming off (powder from falling off).

The sheet product of this invention contains the tubular or fibrous moisture adsorbent and the cellulosic fibrillated fiber as components (a) and (b), and these two are entangled with each other to form an aggregate. Therefore, moisture adsorbed on the moisture adsorbent surface effectively moves to the cellulosic fibrillated fiber having hydroxyl groups by capillarity, and as a result, the adsorption to fresh moisture is promoted on the moisture adsorbent surface from which the moisture has moved, and the adsorption amount and adsorption speed of moisture can be further improved.

The sheet product of this invention contains, as a component (c), an organic fiber having a fineness of 0.01 dtex to 0.45 dtex, and this organic fiber forms a three dimensional network space. In the sheet product of this invention, therefore, the above aggregate formed of the components (a) and (b) comes to be present in the above three-dimensional network space. Therefore, an uneven feeling produced by the aggregate is removed, and hence the sheet product can be improved in uniformity. Further, the aggregate is held in the three-dimensional network, and the content of the moisture adsorbent can be further increased while improving the effect that the moisture adsorbent is kept from coming off (powder from falling off).

Having high moisture absorption and release capability, the sheet product of this invention can be used as a humidity-adjusting sheet product that is regenerable at an ordinary temperature. When a dehumidifying device or a heat-exchanger device is produced using an article formed of the sheet product of this invention, these devices can be downsized, and an air-conditioning apparatus and a total heat-exchanger device can be decreased in size. Further, since the sheet product of this invention has a large moisture release speed, the heating power for releasing moisture can be decreased as compared with conventional products, and an air-conditioning apparatus and a total heat-exchanger device can be further decreased in size.

PREFERRED EMBODIMENTS OF THE INVENTION

Figure 1:
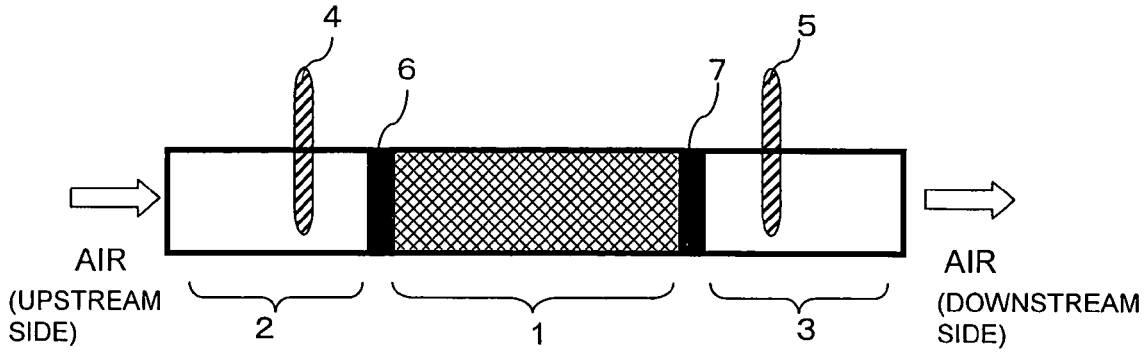
FIG. 1 is a schematic cross-sectional view of an apparatus for moisture absorption and release measurements used in Examples of this invention.

First, the sheet product of this invention will be explained.

The sheet product of this invention comprises (a) a moisture adsorbent formed of a tubular or fibrous metal oxide, (b) a cellulosic fibrillated fiber, and (c) an organic fiber having a fineness of 0.01 dtex to 0.45 dtex. In the sheet product of this invention, the moisture adsorbent formed of a tubular or fibrous metal oxide as a component (a) includes those formed of metal oxide of at least one metal atom selected from silicon, titanium, aluminum, tantalum, vanadium, zirconium, zinc, magnesium, calcium, etc., and it is preferably selected from those formed of silica, titanium oxide, aluminum silicate, aluminosilicate, etc.

When the moisture adsorbent is formed of tubular or fibrous crystalline titanium oxide, its composition can be represented by $(Na,H)_nTiO_{(n+4)/2}$ or $(K,H)_nTiO_{(n+4)/2}$ in which n is an integer of 0 to 20, and "n=0" shows the state of being titanium oxide. In the above formulae, n is preferably 1 to 20, particularly preferably 1. Further, when the moisture adsorbent is formed of a tubular or fibrous aluminum silicate, the moisture adsorbent as a component (a) for constituting the sheet product of this invention includes an amorphous or crystalline tubular or fibrous aluminum silicate represented by $SiO_2.Al_2O_3.2H_2O$.

When the metal oxide is tubular, the outer diameter of each cross section of such tubes is preferably 2 nm to 80 nm, more preferably 5 nm to 50 nm. When the outer diameter of the cross section is less than 2 nm, the moisture adsorbent is liable to comes off the sheet product. When it exceeds 80 nm, the specific surface area of the moisture adsorbent is small and the moisture absorption amount is sometimes decreased. The length of the tubular metal oxide in the length direction is preferably 0.5 nm to 10 μm, more preferably 2 nm to 100 nm. The aspect ratio (length in the length direction/outer diameter of cross section) of the tubular metal oxide is preferably 0.15 to 100,000, more preferably 0.7 to 10,000. When the metal oxide is tubular, the thickness of each wall of such tubes is preferably 0.5 nm to 20 nm, more preferably 1 nm to 10 nm.

When the above metal oxide is fibrous, the outer diameter of cross section thereof is preferably 2 nm to 80 nm, more preferably 5 nm to 50 nm. When the outer diameter of the cross section is less than 2 nm, the moisture adsorbent is liable to come off the sheet product. When it exceeds 80 nm, the specific surface area is small, and the moisture absorption amount of the moisture adsorbent is sometimes decreased. The length of the fibrous metal oxide in the length direction is preferably 20 nm or more, more preferably 100 nm or more. When the length in the length direction is less than 20 nm, the moisture adsorbent is liable to come off the sheet product. The upper limit of the length is not specially limited, and the length may exceed 10 μm. Further, the aspect ratio (length in the length direction/outer diameter of cross section) of the fibrous metal oxide is preferably 2 to 100,000, more preferably 5 to 10,000.

The tube wall of the tubular metal oxide or the fiber surface of the fibrous metal oxide may have fine pores having a diameter of 0.1 μm to 5.0 μm, and such fine pores can also improve the adsorptivity to moisture.

In the present specification, various lengths of components for constituting the sheet product and materials therefor refer to values obtained by measurements through a scanning electron microscope (SEM).

The moisture adsorbent formed of the tubular or fibrous metal oxide is preferably used in the form of an aggregate having a porous structure such as a network structure, a form of balls made of yarns, pumice, or the like in which tubes or fibers formed of the metal oxide are arranged at random. When the aggregate has such a structure, a decrease in the adsorption area can be prevented as compared with an aggregate in which tubes or fibers formed of metal oxide are regularly arranged.

In the sheet product of this invention, the specific surface area of the moisture adsorbent as a component (a), measured by a BET method, is preferably 300 $m^2/g$ or more, more preferably 350 $m^2/g$ or more, still more preferably 370 $m^2/g$ or more. When the above specific surface area is less than 300 $m^2/g$, it is required to increase the content of the moisture adsorbent in the sheet product, and the processability of the sheet product may be sometimes decreased. The upper limit of the specific surface area is preferably 700 $m^2/g$.

When the moisture adsorbent as a component (a) for constituting the sheet product of this invention is formed of tubular or fibrous crystalline titanium oxide having a composition of $(Na,H)_nTiO_{(n+4)/2}$ or $(K,H)_nTiO_{(n+4)/2}$ (n is an integer of 0 to 20), the tubular or fibrous titanium oxide can be obtained from a raw material containing, as a main component, at least one member selected from titanium oxide, titanium oxide salt and a titanium oxide intermediate by hydrothermal synthesis in a highly concentrated alkaline aqueous solution.

The raw material for the tubular or fibrous titanium oxide includes an anatase type or rutile type titanium oxide synthesized by a sulfuric acid method, a hydrochloric acid method, a sol-gel method, etc., and intermediates such as metatitanic acid, orthotitanic acid, etc. When the efficiency of conversion to fibrous titanium oxide during hydrothermal synthesis is taken into account, the raw material for the tubular or fibrous titanium oxide is preferably selected from anatase type finely particulate titanium oxide having a particle diameter of 2 to 100 nm or metatitanic acid.

As a method for producing anatase type finely particulate titanium oxide by a sulfuric acid method, for example, there can be employed a method in which an ilmenite ore whose main component is FeO $TiO_2$ is reacted with sulfuric acid to sulfurize Ti, Fe, etc., whereby obtaining water-soluble sulfates such as $TiOSO_4$, $FeSO_4$, etc., and then, the steps of still standing, freeing from crystal, filtering, concentration, etc., are carried out to remove an impurity, followed by hydrolysis for precipitation as a metatitanic acid and the steps of neutralization washing, drying, calcining, pulverization, etc., to obtain anatase type finely particulate titanium oxide. As described above, metatitanic acid is an intermediate in the production of anatase type finely particulate titanium oxide by a sulfuric acid method, and it is available in a step in the middle of the production, so that the production steps can be advantageously simplified. That amorphous portion of metatitanic acid which exhibits no crystallization has high reactivity to the hydrothermal synthesis in the production of a tubular or fibrous titanium oxide, so that the reaction efficiency can be improved.

The tubular or fibrous titanium oxide obtained by hydrothermal synthesis is in many cases obtained as an aggregate having a network structure, etc., and the diameter of this aggregate (length of the longest portion of the aggregate) is 0.1 μm to 10 μm. It is fully washed with water by a centrifugal separation method, etc., and, further, neutralized with an inorganic acid such as diluted further, neutralized with an inorganic acid such as diluted hydrochloric acid, etc., or an organic acid such as acetic acid, etc., and an excess alkali component is removed, whereby the intended tubular or fibrous titanium oxide can be obtained. The tubular or fibrous titanium oxide may be dried or may be used in the form of a slurry. When tubular or fibrous titanium oxide having a macro structure other than the network structure is produced, production conditions such as a raw material concentration, etc., can be adjusted as required.

As an alkali component for use in the hydrothermal synthesis, potassium hydroxide or sodium hydroxide can be used, and the concentration of the alkali component is preferably 10 to 25 mol/kg, more preferably 15 to 20 mol/kg.

The treatment temperature in the hydrothermal synthesis is preferably 70 to 150° C., more preferably 100 to 130° C. The treatment time period is generally 5 to 40 hours.

When the moisture adsorbent as a component (a) for constituting the sheet product of this invention is an amorphous or crystalline tubular or fibrous aluminum silicate represented by $SiO_2.Al_2O_3.2H_2O$, the method for the production of the tubular or fibrous aluminum silicate includes the following method.

First, as raw materials for the tubular or fibrous aluminum silicate, a silicon source such as an inorganic silicon compound, etc., and an aluminum source such as an inorganic aluminum compound are used. The silicon source can be any silicon source so long as it is a monosilicic acid compound, and it can be selected from sodium ortho-silicate, sodium meta-silicate, amorphous colloidal silicon dioxide, etc. The aluminum source can be any aluminum source as long as it can provide aluminum ion, and it includes aluminum compounds such as aluminum chloride, aluminum nitrate, etc. The silicon source and aluminum source shall not be limited to the above compounds.

For obtaining the tubular or fibrous aluminum silicate, first, an aqueous solution of the above silicon source and an aqueous solution of the above aluminum source are prepared, respectively, and these aqueous solutions are mixed to carry out a reaction. In this case, preferably, they are mixed so as to attain a silicon/aluminum molar ratio of 0.3 to 1.0. When they are mixed, preferably, a 1 mmol/l to 500 mmol/l silicon source aqueous solution and 1 mmol/liter to 1,500 mmol/l aluminum source aqueous solution are used.

After the aluminum source aqueous solution and the silicon source aqueous solution are mixed, the pH of the mixture is adjusted from weak acidity to neutrality by adding an alkaline aqueous solution dropwise, to generate a precursor. The alkaline aqueous solution for a neutralizing reaction in the step of generating the above precursor includes, for example, an aqueous solution of sodium hydroxide, potassium hydroxide, ammonia, or the like, and preferably, the precursor is generated at a pH in the range of 4 to 7.

Then, the treatment of deionization for removing co-present ion from the aqueous solution containing the above precursor is carried out by means of centrifugal separation, filtering, membrane separation, or the like, and then the precursor recovered is dispersed in pure water or an acidic aqueous solution. The acidic aqueous solution includes inorganic acids such as hydrochloric acid, nitric acid, perchloric acid, etc. Then, the thus-obtained precursor dispersion is subjected to aging treatment or heating treatment with stirring at room temperature. The aging treatment temperature is preferably 20° C. to 30° C., and the aging treatment time period is preferably 5 minutes to 48 hours, more preferably 10 minutes to 6 hours. The heating treatment temperature is preferably 50° C. to 120° C., more preferably 90° C. to 110° C., and the heating treatment time period is preferably 5 minutes to 48 hours, more preferably 10 minutes to 6 hours. When the heating treatment is carried out, tubular aluminum silicate is liable to be obtained, and the length thereof tends to grow in the length direction.

When the precursor dispersion that has been subjected to the aging treatment or heating treatment is dried, tubular aluminum silicate can be obtained. The drying temperature is preferably 100° C. or lower, more preferably 0° C. to 80° C.

The content of the component (a) (moisture adsorbent) in the sheet product of this invention is preferably 30 mass % to 90 mass %, more preferably 35 mass % to 80 mass %, still more preferably 40 mass % to 70 mass %. When the content of the moisture adsorbent is less than 30 mass %, no sufficient moisture absorption capability can be obtained in some cases. When it exceeds 90 mass %, the sheet product has insufficient flexibility, and it may be broken or gets out of shape when subjected to processing such as pleating, corrugating, roll core processing, etc.

The sheet product of this invention contains, as a component (a), the moisture adsorbent formed of the tubular or fibrous metal oxide, and this moisture adsorbent has a large specific surface area, the surface having hydrophilic nature, so that the use of this moisture adsorbent can give high moisture adsorption capability. In the sheet product of this invention, the moisture adsorbent adsorbs moisture mainly on its surface as described above, so that the sheet product can release moisture at a temperature in the range of 40 to 80° C. and can be hence regenerated at a low temperature.

Further, the tubular or fibrous metal oxide constituting the above moisture adsorbent can easily form an aggregate having a network pores in the form of a network structure, a structure having the form of balls made of yarns, pumice, etc., and the surface of the aggregate positively holds moisture in network of pores by means of capillarity. Therefore, the sheet product of this invention containing the above moisture adsorbent is capable of increasing the moisture absorption speed and the moisture release speed and hence performing moisture absorption and release for a short period of time as compared with a sheet product using, as a moisture adsorbent, a structure that adsorbs moisture therein, such as a highly water-absorptive polymer, a porous inorganic powder, or the like.

Moreover, the tubular or fibrous moisture adsorbent is easily entangled with other fibers constituting the sheet product owing to the above network structure or the structure having the form of balls made of yarns, so that the sheet product having the above tubular or fibrous moisture adsorbent, provided by this invention, can have an increased content of the moisture adsorbent while keeping moisture adsorbent from coming off (powder from falling off) as compared with any conventional sheet product using a spherical or particulate moisture adsorbent.

In the sheet product of this invention, the cellulosic fibrillated fiber means cellulosic fibers of which the surfaces have whisker-like branched portions each or fine fibers formed by finely splitting a fiber itself in the direction mainly in parallel with the fiber axis.

In the cellulosic fibrillated fiber, preferably, at least part of each whisker-like branched portion or split fine fiber has a diameter of 1 μm or less in cross section. The aspect ratio (fiber length (length in the longitudinal direction)/fiber diameter (diameter in cross section)) of the cellulosic fibrillated fiber is preferably in the range of 20 to 100,000. Further, the Canadian standard freeness (JIS P8121) of the cellulosic fibrillated fiber is preferably 500 ml or less, more preferably 200 ml or less. Further, the mass average fiber length thereof is preferably in the range of 0.1 mm to 2 mm.

Examples of the method for the production of the above cellulosic fibrillated fiber include (1) a method in which a cellulosic material as a highly crystalline highly oriented material is prepared in the form of pulp or in the form of pellets having a proper size and the pulp or pellets are dispersed in water and fibrillated with a beater, a conical refiner, a single disk refiner, a double disk refiner, a high-pressure homogenizer, a sand mill, etc., (see JP3-174091A), and (2) a method in which bacteria cellulose produced by microorganisms such as acetobactor, etc., is macerated (see JP7-118303A).

The cellulosic material that can be used in the above method (1) includes vegetable fibers such as wood pulp, paper mulberry, *Edgeworthia papyrifera*, straws, kenaf, bamboo, linter, bagasse, esparto, sugar cane, etc., rayon fibers that are cellulose regeneration fibers, semi-synthetic fibers such as acetate, etc., Lyocell fiber, fibers obtained from parenchyma cells of plants, etc. The parenchyma cells of plants can be obtained by pulverizing internal soft tissues of stalks, mesophyll of leaves, fruits, etc. Further, there can be also used strained lees of juice from fruits and strained lees of sugar beats, sugar canes, etc., which are exhausted from a food processing plant, a sugar factory, etc. A fiber can be obtained by subjecting the parenchyma cells of plants to pulping treatment that is applied to the production of pulp from wood. These cellulosic materials may be used singly or in combination of at least two of them.

The content of the cellulosic fibrillated fiber in the sheet product of this invention is preferably 1 mass % to 15 mass %, more preferably 3 mass % to 10 mass %, still more preferably 5 mass % to 8 mass %. When the content of the cellulosic fibrillated fiber is less than 1 mass %, an aggregate formed of the component (a) and the component (b) to be described later is hard to form when the sheet product is produced by a paper-making method, and the yield of the paper-making may decrease. Further, it may be sometimes observed that a powder comes of the sheet product. When it exceeds 15 mass %, the filterability during the paper making may be degraded or the wire of a paper-making machine may be clogged with cellulosic fibrillated fiber.

The sheet product of this invention contains the cellulosic fibrillated fiber as a component (b). This cellulosic fibrillated fiber is finely divided owing to whisker-like branched portions or fine fibers and has a large specific surface area. Further, fibers of the cellulosic fibrillated fiber are entangled well. Therefore, the cellulosic fibrillated fiber is excellent in the capability of holding the moisture adsorbent, and it can have an increased content of the moisture adsorbent while improving the effect that the moisture adsorbent is kept from coming off (powder from falling off). Further, since the cellulosic fibrillated fiber has surface functional groups such as a hydroxyl group, etc., it has high affinity for the tubular or fibrous moisture adsorbent having high hydrophilic nature. In this point, the content of the moisture adsorbent in the sheet product of this invention can be also increased while improving the effect that the moisture adsorbent is kept from coming off (powder from falling off).

In the sheet product of this invention, the component (a) and the component (b) are entangled to form an aggregate, and moisture adsorbed on the moisture adsorbent surface hence efficiently moves to the cellulosic fibrillated fiber having a hydroxyl group by capillarity. As a result, the moisture adsorption is freshly promoted on the moisture adsorbent surface from which moisture has moved, so that the moisture adsorption amount and adsorption speed can be further improved.

In the sheet product of this invention, the organic fiber having a fineness of 0.01 dtex to 0.45 dtex for use as a component (c) includes those formed of various organic fibers having the property of being undissolved in water.

Examples of the material for constituting the above organic fiber include an olefin resin, a polyester resin, an ethylene-vinyl acetate copolymer resin, a polyamide resin, an acrylic resin, a polyvinyl chloride resin, a polyvinylidene chloride resin, a polyvinyl ether resin, a polyvinyl ketone resin, a polyether resin, a diene-based resin, a polyurethane resin, a phenolic resin, a melamine resin, a furan resin, a urea resin, an aniline resin, an unsaturated polyester resin, an alkyd resin, a wholly aromatic polyamide resin, a wholly aromatic polyester resin, a wholly aromatic polyester amide resin, a wholly aromatic polyether resin, a wholly aromatic polycarbonate resin, a wholly aromatic polyazomethine resin, a polyphenylene sulfide resin, a poly-p-phenylenebenzobisthiazole resin, a poly-p-phenylenebenzobisoxazole resin, a polybenzoimidazole resin, a polyether ether ketone resin, a polyamide imide resin, a polyimide resin, a polytetrafluoroethylene resin, acryls, etc. Further, it can be also selected from vegetable fibers such as wood pulp, paper mulberry, *Edgeworthia papyrifera*, straws, kenaf, bamboo, linter, bagasse, esparto, sugar cane, etc., rayon fibers that are cellulose regeneration fibers, semi-synthetic fibers such as acetate, etc., Lyocell fiber, etc., and various heat-fusible fibers can be also employed.

In the sheet product of this invention, the fineness of the organic fiber as a component (C) is 0.01 dtex to 0.45 dtex, preferably 0.02 dtex to 0.40 dtex, more preferably 0.05 dtex to 0.35 dtex. The fiber length thereof is preferably 2 mm to 20 mm, more preferably 2 mm to 15 mm, still more preferably 3 mm to 5 mm.

The content of the component (c) based on the sheet product of this invention is preferably 1 mass % to 69 mass %, more preferably 10 mass % to 62 mass %, still more preferably 22 mass % to 55 mass %. When the content of the component (c) is less than 1 mass %, the aggregate formed of the components (a) and (b) may be no longer held in the sheet product, and when the sheet product is produced by a paper-making method, the retention of a powder in the paper-making may decrease in some cases. When it exceeds 69 mass %, the filterability during the paper-making may be degraded in some cases.

The sheet product of this invention contains, as a component (c), the organic fiber having a fineness of 0.01 to 0.45 dtex, and this organic fiber forms a three-dimensional network space. In the sheet product of this invention, therefore, the aggregate formed of the above components (a) and (b) comes to be present in the above three-dimensional network space. Therefore, an uneven feeling produced by the aggregate is removed, and hence the sheet product can be improved in uniformity. Further, the aggregate is held in the three-dimensional network, and the content of the moisture adsorbent can be further increased while improving the effect that the moisture adsorbent is kept from coming off (powder from falling off).

The sheet product of this invention preferably contains a fiber bondable under moisture and heat as a component (d).

In the present specification, the fiber bondable under moisture and heat means a polymer bondable under moisture and heat which is softened with a hot water having a temperature of 60° C. or higher but 100° C. or lower to exhibits the property of self-bonding or bonding to other fiber.

Examples of the polymer bondable under moisture and heat include a polymer containing nylon 12 or acrylamide as one component, polylactic acid, an ethylene-vinyl alcohol copolymer, polyvinyl acetate, a polyvinyl alcohol polymer, etc. These may be used singly or may be used in combination of at least two of them. An ethylene-vinyl alcohol copolymer and a polyvinyl alcohol polymer are preferably used since their monofilament fineness can be decreased, since their bondability under moisture and heat can be controlled and since they have high affinity for the moisture adsorbent that is a hydrophilic component (a) and the cellulosic fibrillated fiber that is a component (b) owing to an effect produced by hydroxyl group. When the ethylene-vinyl alcohol copolymer or the polyvinyl alcohol polymer is used, the sheet product is improved in mechanical strength. In the production of the sheet product by a paper-making method, the yield of the product is also improved, and a powder is kept from falling off.

The ethylene content in the ethylene-vinyl alcohol copolymer is preferably 20 mol % to 70 mol %, more preferably 30 mol % to 55 mol %, still more preferably 35 mol % to 50 mol %. When the ethylene content is 20 mol % to 70 mol %, the ethylene-vinyl alcohol copolymer can exhibits the specific property of having bondability under moisture and heat and being softened with hot water while maintaining a fiber state. When the ethylene content is less than 20 mol %, the ethylene-vinyl alcohol copolymer may sometimes have problems with regard to its spinability and durability. In a fiber containing the ethylene-vinyl alcohol copolymer (ethylene-vinyl alcohol copolymer fiber), further, a vinyl alcohol portion of the fiber surface exhibits bondability under moisture and heat. When the ethylene content exceeds 70 mol %, therefore, no sufficient bondability under moisture and heat may be exhibited in some cases.

The saponification degree of the polyvinyl alcohol polymer is preferably 90.00 mol % to 99.99 mol %. When the saponification degree is less than 90.00 mol % or more than 99.99 mol %, it is difficult to form a fiber.

In the sheet product of this invention, the fineness of the fiber bondable under moisture and heat as a component (d) is preferably 0.01 dtex to 5.0 dtex, more preferably 0.01 dtex to 1.5 dtex. When the above fineness is smaller than 0.01 dtex, the mechanical strength of the fiber bondable under moisture and heat itself may be sometimes decreased to excess, and the dispersibility in water is sometimes degraded when the sheet product is produced by a paper-making method, or the like. When the fineness exceeds 5.0 dtex, the surface area of the fiber is too small, and the capability of holding the aggregate structure in the sheet product is sometimes decreased. Further, the sheet strength after a drying step is also decreased in some cases. The fiber length of the fiber bondable under moisture and heat is preferably 2 mm to 20 mm, more preferably 2 mm to 15 mm, still more preferably 3 mm to 5 mm.

When the sheet product of this invention contains the fiber bondable under moisture and heat as a component (d), the content of the fiber bondable under moisture and heat based on the sheet product is preferably 1 mass % to 15 mass %, more preferably 2 mass % to 12 mass %, still more preferably 5 mass % to 10 mass %. When the content of the fiber bondable under moisture and heat is less than 1 mass %, the sheet product is in many cases not any better than a sheet product containing no fiber bondable under moisture and heat with regard to the property of keeping a powder from falling off and mechanical strength. When the content of the fiber bondable under moisture and heat exceeds 15 mass %, the bonding nature may be too high during the production of the sheet product and workability may be degraded in some cases. Further, when the sheet product of this invention contains the fiber bondable under moisture and heat, the content of the organic fiber having a fineness of 0.01 dtex to 0.45 dtex as a component (c) is preferably 1 mass % to 69 mass %, more preferably 10 mass % to 60 mass %, still more preferably 15 mass % to 50 mass %.

In the sheet product of this invention, the fiber bondable under moisture and heat as a component (d) has a portion in a wet state generated through a vinyl alcohol group, etc., on the fiber surface, and it in many cases exits in a swollen state in water having a temperature lower than its softening temperature. When the sheet product is produced by a paper-making method, etc., the above fiber bondable under moisture and heat easily comes into a dehydrated state and thermally bonds to the aggregate formed of the components (a) and (b) and the organic fiber that is a component (c). That is, when the drying step in the paper making has the softening temperature in a state where water is present, the fiber bondable under moisture and heat bonds to itself or bonds to the aggregate formed of the components (a) and (b) and the like, and when the drying is further carried out thereafter, part of the fiber bondable under moisture and heat changes from a fiber state to a film state or a lump state. In this manner, the fiber bondable under moisture and heat as a component (d) bonds to the moisture adsorbent as a component (a), the cellulosic fibrillated fiber as a component (b) and the organic fiber as a component (c), As a result, the yield in paper making can be improved and a powder can be kept from falling off when the sheet product is used. Further, the sheet product is improved in mechanical strength and hence becomes easily processable. When the sheet product is rubbed or a heavy article is placed on the sheet product like a packaging material or a moisture adsorbent in a closet, a powder or fiber can be kept from falling off.

The sheet product of this invention may contain, as a component (d), an organic fiber having a fineness of over 0.45 dtex but not more than 2.5 dtex.

As a material for the organic fiber that is a component (e), there can be used an organic fiber that is the same as the organic fiber having a fineness of 0.01 dtex to 0.45 dtex as a component (c) except for its fineness.

The fineness of the organic fiber as a component (e) is preferably 0.50 dtex to 2.2 dtex, more preferably 0.50 dtex to 2.0 dtex.

When the sheet product of this invention contains, as a component (e), the organic fiber having a fineness of over 0.45 dtex but not more than 2.5 dtex, the organic fiber having a fineness of over 0.45 dtex but not more than 2.5 dtex as a component (e) reinforces the dense three-dimensional network that the organic fiber having a fineness of 0.01 dtex to 0.45 dtex as a component (c), a stronger and more uniform network structure can be formed, and the sheet product can be improved in texture and flexibility. In particular, the sheet product can be remarkably improved in the mechanical strength and stretchability that are required when it is corrugated or pleated.

The sheet product of this invention may contain, as a component (f), a thermally fusible organic fiber having a fineness of over 0.45 dtex but not more than 2.5 dtex.

The material for the thermally fusible organic fiber as a component (f) includes a monofilament and composite fibers such as a core-in-sheath fiber (core-shell type), a parallel fiber (side-by-side type), a radially split fiber, etc. The composite fiber does not easily form a coating film, so that it can improve mechanical strength and prevent a powder from falling off without needlessly coating the fibrous moisture adsorbent surface but with maintaining air permeability. Examples of the thermally fusible organic fiber include a monofilament of polypropylene, a composite fiber formed of polypropylene (core) and polyethylene (sheath) and a composite fiber formed of high melting point polyester (core) and low melting point polyester (sheath). A monofilament (wholly meltable type) composed of only a low melting point such as polyethylene easily forms a coating film in a drying step, while it may be used so long as it does not impair properties.

The fineness of the organic fiber as a component (f) is preferably 0.80 dtex to 2.5 dtex, more preferably 1.0 dtex to 2.5 dtex. The fiber length of the thermally fusible organic fiber is preferably 2 mm to 20 mm, more preferably 2 mm to 15 mm, still more preferably 3 mm to 5 mm.

When the sheet product of this invention contains the thermally fusible organic fiber as a component (f), the sheet product has an increased mechanical strength and hence is easily processable. Moreover, when the sheet product is used in use fields where its surface is rubbed or a heavy article is placed thereon like a packaging material or a moisture adsorbent in a closet, a powder and a fiber can be kept from falling off.

When the sheet product of this invention contains at least one of the component (e) and the component (f), the total content of the components (e) and (f) based on the sheet product is preferably 1 mass % to 50 mass %, more preferably 10 mass % to 40 mass %, still more preferably 15 mass % to 30 mass %. When the total content of the components (e) and (f) is less than 1 mass %, the flexibility and mechanical strength are in many cases not any better than those of a sheet product containing none of the components (f) and (e). When the total content of the components (e) and (f) exceeds 50 mass %, the three-dimensional network that the organic fiber as a component (c) constitutes may become coarse and its capability of holding the moisture adsorbent may be degraded in some cases. Further, when the sheet product of this invention contains one of the components (e) and (f), the content of the organic fiber having a fineness of 0.01 dtex to 0.45 dtex as a component (c) is preferably 1 mass % to 58 mass %, more preferably 10 mass % to 52 mass %, still more preferably 15 mass % to 40 mass %.

When the sheet product of this invention contains the fiber bondable under moisture and heat as a component (d) and at least one fiber selected from the organic fiber as a component (e) and the thermally fusible organic fiber as a component (f), even if the content of the fiber bondable under moisture and heat is small, there can be obtained a sheet product excellent in mechanical strength owing to an interaction of the cellulosic fibrillated fiber as a component (b) and the fiber bondable under moisture and heat as a component (d) and a three-dimensional network formed of the organic fiber as a component (c) and at least one selected from the organic fiber as a component (e) and the thermally fusible organic fiber as a component (f).

When the sheet product of this invention contains the fiber bondable under moisture and heat as a component (d) and at least one fiber selected from the organic fiber as a component (e) and the thermally fusible organic fiber as a component (f), the preferred content of the component (d) based on the sheet product is as described already, and the total content of the components (e) and (f) is preferably 1 mass % to 50 mass %, more preferably 5 mass % to 40 mass %, still more preferably 10 mass % to 30 mass %. In this case, further, the content of the organic fiber as a component (c) is preferably 4 mass % to 64 mass %, more preferably 8 mass % to 52 mass %, still more preferably 10 mass % to 40 mass %.

The sheet product of this invention may further contain a flame-retarding agent. The sheet product can be imparted with flame retardancy by incorporating the flame-retarding agent. As the above flame-retarding agent, a phosphorus-containing flame retardant, a brominated flame retardant, a chlorinated flame retardant, a nitrogen-containing flame retardant, a silicon-containing flame retardant, an inorganic flame retardant, etc., are known. A polymer type flame retardant such as a vinyl chloride-ethylene copolymer can be also used. The above inorganic flame-retarding agent includes metal hydroxides such as aluminum hydroxide, magnesium hydroxide, zirconium hydroxide and hydroxides of metatitanic acid, etc. In particular, aluminum hydroxide is a less expensive and more preferable material, and it is also preferred to use it in combination with a polymer type flame retardant.

When aluminum hydroxide or the like is used as a flame-retarding agent, the method for mixing it includes a method in which it is mixed with components for constituting a sheet product and a sheet product is produced from the mixture by a paper-making method, etc. When the content of aluminum hydroxide is increased, however, it is required to decrease the content of the moisture adsorbent as a component (a) relatively in the sheet product, so that it is sometimes difficult to impart flame retardancy by incorporating aluminum hydroxide alone. It is hence preferred to use a halogen-containing compound, phosphoric esters, latex such as a vinyl chloride-ethylene copolymer, etc., in combination with aluminum hydroxide by impregnating the sheet product with any one of them or by spraying or applying any one of them to the sheet product.

Further, the sheet product of this invention may contain a metal fiber of stainless steel, nickel, etc., a carbon fiber, a ceramic fiber, a glass fiber, etc., so long as the flexibility is not impaired. Further, it may contain a highly water-absorptive polymer, an organic moisture adsorbent such as carboxymethyl cellulose, etc., and an inorganic moisture adsorbents such as sepiolite, zeolite, bentonite, attapulgite, diatomite, activated carbon, silica gel, aluminum hydroxide, allophane, etc.

The basis weight of the sheet product of this invention is preferably 25 g/m$^2$ to 250 mg/m$^2$ more preferably 30 g/m$^2$ to 200 mg/m$^2$, still more preferably 40 g/m$^2$ to 150 mg/m$^2$. The thickness thereof is preferably 36 μm to 415 μm, more preferably 43 μm to 333 μm, still more preferably 57 μm to 250 μm.

The sheet product of this invention may have a single-layer structure or a multiple-layer structure. Since, however, the moisture adsorbent as a component (a) and the cellulosic fibrillated fiber as a component (b) are contained, a dispersion slurry has a high viscosity when a sheet product is produced by a paper-making method, and when an attempt is made to obtain a sheet product having a high basis weight in the form of a single layer, the filterability is degraded, so that it is difficult to produce the sheet product in a paper-making manner, and its formation is sometimes made poor. For example, when a sheet product having a basis weight of 100 g/m$^2$ is produced, therefore, a sheet product having a better formation can be produced with a combination paper making machine by employing a two-layer structure of 50 g/m$^2$+50 g/m$^2$ or a three-layer structure of 30 g/m$^2$+30 g/m$^2$+40 g/m$^2$.

The sheet product of this invention is preferably that which is produced by a paper-making method.

When the sheet product of this invention is produced by a paper-making method, the moisture adsorbent as a component (a) is excellent in hydrophilic nature on its surface, and when it is subjected to mechanical treatment in water, such as dispersion, it is charged. In this state, when the chargeability of the moisture adsorbent dispersed in water is controlled by mixing it with the cellulosic fibrillated fiber as a component (b) and further adding a coagulating agent, the moisture adsorbent as a component (a) forms an aggregate with entangling the cellulosic fibrillated fiber as a component (b) in, and forms a dispersion slurry.

When it is attempted to increase the content of a moisture adsorbent in a sheet product, generally, the proportion of a waste on the drain side increases during the paper making, and the proportion of a remainder on the sheet product side (yield of paper making) decreases. The sheet product of this invention contains the cellulosic fibrillated fiber as a component (b), and this component (b) forms an aggregate with the moisture adsorbent as a component (a), whereby an excellent yield of paper making can be retained.

The coagulating agent for structurally stabilizing the aggregate formed of the component (a) and the component (b) includes basic or amphoteric metal hydroxides such as sodium hydroxide, potassium hydroxide, lithium hydroxide, zinc hydroxide, aluminum hydroxide, magnesium hydroxide, etc., inorganic hydrous hydroxides such as alumina, silica, aluminum silicate, magnesium hydroxide, etc., water-soluble polymers such as aluminum sulfate, polyaluminum chloride, anion- or cation-modified polyacrylamide, a similar polyethylene-oxide-containing polymer, an acrylic acid or methacrylic acid-containing copolymer, etc., alginic acid or polyvinyl phosphoric acid and alkaline salts of these, ammonia, alkyl amines such as diethylamine and ethylenediamine, alkanolamines such as ethanolamine, pyridine, morpholine, an acryloyl morpholine-containing polymer, etc. In particular, of the anion- or cation-modified water-soluble polymer coagulating agents, an amphoteric coagulating agent having both a cation unit and an anion unit in the polymer exhibits an excellent effect. Before or after a dispersion slurry containing the aggregate of the above components (a) and (b) is formed, the organic fiber as a component (c) is added, and further, the fiber bondable under moisture and heat as a component (d), the organic fiber as a component (e), the thermally fusible organic fiber as a component (f), a filler, a dispersing agent, a thickener, an antifoaming agent, a paper strength additive, a sizing agent, a coagulating agent, a colorant, an adhesion promoter, etc., are added as required, followed by making paper with a paper-making machine. The paper-making machine can be selected from paper-making machines such as a cylinder paper machine, a Fourdrinier paper machine, a short-wire paper machine, an inclined type paper machine and a combination paper machine that is a combination of these machines of a similar or different type. A wet paper after paper making is dried with an air dryer, a cylinder dryer, a suction drum dryer, an infrared drying dryer or the like, whereby the sheet product of this invention can be obtained. According to the above paper-making method, a less expensive and highly uniform sheet product can be produced in a large amount.

The article of this invention will be explained below.

The article of this invention is characteristically formed of the sheet product of this invention.

The article of this invention includes those obtained by applying, for example, a pleating process, a corrugating process, a laminating process, a roll core process, a doughnut process, etc., to the sheet product of this invention. The article obtained by applying a laminating process includes articles obtained by laminating and integrating the sheet product of this invention and paper, a nonwoven fabric, a woven fabric, a knitted cloth, a woven cloth, a film, a porous film, etc.

In the steps of producing the article of this invention, heating is required in the step of drying a sheet product after paper making, the step of drying after the step of an impregnation process if it is carried out, the step of drying an adhesive in the corrugating process or laminating process, etc. In these steps, the temperature to which the moisture adsorbent constituting the sheet product is exposed is generally 80° C. to 150° C., or approximately 170° C. at the highest. In the moisture adsorbent constituting the sheet product of this invention, its crystal structure does not change, and its moisture adsorption capability does not decrease, up to approximately 250° C. Unlike any conventional inorganic fiber paper, it is exposed to no high temperature in the processes of making the sheet product and the article, so that it can be kept from being degraded in properties. Further, conventional moisture adsorbents require a regeneration temperature of 80° C. or higher, while the sheet product and the article of this invention can be regenerated in a temperature range of at least 40° C. but not more than 80° C.

The article of this invention can be used, for example, as a humidity-controller device or a heat-exchange device. Specific examples of the humidity-controller device and the heat-exchanger device include a dehumidification rotor device, a device for a vaporization type humidifier for building air conditioning, a device for a humidifier for fuel cells, a water absorption evaporator device for vending machines, a water absorption evaporator device for cooling, a dehumidification rotor device for desiccant air conditioning, etc.

Examples

This invention will be more specifically explained below with reference to Examples, while this invention shall not be limited by these Examples. In Examples and Comparative Examples, "part" and "percentage" are based on weight unless otherwise specified.

(Components for Constituting Sheet Products)

Table 1 shows moisture adsorbents and flame-retarding agents used as components for constituting sheet products in Examples and Comparative Examples, and Table 2 shows a list of fibers used as components for constituting sheet products in Examples and Comparative Examples. Methods for the preparation of moisture adsorbents (a-I) to (a-III) and a comparative moisture adsorbent I will be described below.

<Preparation of Moisture Adsorbent (a-I)>

To anatase titanium oxide particles obtained by a sol-gel method was added an aqueous solution having a potassium hydroxide concentration of 20 mol/kg, and the mixture was heated at a temperature of 120° C. for 24 hours. The resultant slurry-like product was repeatedly washed with water, further, neutralized with acetic acid and again fully washed with water to remove a superfluous ion component. Then, centrifugal separation was carried out to give a dispersion (concentration 20 mass %) of fibrous titanium oxide having a network structure as a macrostructure (to be referred to as "moisture adsorbent (a-I)" hereinafter). Part of the dispersion was dried to obtain moisture adsorbent (a-I) in the form of a powder, and the powder was measured for a specific surface area according to a BET method to show that it had a specific surface area of 350 $m^2/g$.

<Preparation of Moisture Adsorbent (a-II)>

A sodium orthosilicate aqueous solution (concentration 0.1 mol/L) and aluminum chloride (concentration 0.15 mol/L) were added in equivalent amounts with fully stirring. Further, 1N sodium hydroxide was gradually added to attain a pH of 6, the mixture was fully washed with water, and IN hydrochloric acid was added to attain a pH of 4. The mixture was heated at 100° C. for 2 days to give amorphous aluminum silicate. Washing with water was again carried out to remove a superfluous ion component, and then centrifugal separation was carried out to give a slurry of 20% concentrated amorphous silicate having a tubular structure (to be referred to as "moisture adsorbent (a-II)" hereinafter). Part of the slurry was dried to obtain moisture adsorbent (a-II) in the form of a powder, and the powder was measured for a specific surface area according to a BET method to show that it had a specific surface area of 450 $m^2/g$.

<Preparation of Moisture Adsorbent (a-III)>

To a dry product of metatitanic acid was added an aqueous solution having a potassium hydroxide concentration of 20 mol/g, and the mixture was heated at a temperature of 120° C. for 10 hours. The resultant slurry-like product was repeatedly washed with water, further, neutralized with hydrochloric acid and again fully washed with water to remove a superfluous ion component. Then, it was dried to give a fibrous titanium oxide having a network structure as a macrostructure (to be referred to as "moisture adsorbent (a-III)" hereinafter). The thus-obtained moisture adsorbent had a specific surface area, measured according to a BET method, of 400 $m^2/g$.

<Preparation of Comparative Moisture Adsorbent I>

To a sodium orthosilicate aqueous solution (concentration 1 mol/L) was added a hexadecyltrimethyl ammonium/butanol solution, and the mixture was heated at 70° C. for 10 hours. 2N hydrochloric acid was added to the resultant solution to adjust its pH to 2.0, and centrifugal separation was carried out, followed by washing with water and drying. The resultant product was calcined at 600° C. for 4 hours to give spherical porous silica (to be referred to as "comparative moisture adsorbent I" hereinafter). The thus-obtained moisture adsorbent had a specific surface area, measured according to a BET method, of 600 $m^2/g$.

TABLE 1

| | |
|---|---|
| Moisture adsorbent (a-I) | Fibrous titanium oxide having network structure as a macrostructure (specific surface area by BET method, 350 $m^2/g$) |
| Moisture adsorbent (a-II) | Amorphous aluminum silicate having tubular structure (specific surface area by BET method, 450 $m^2/g$) |
| Moisture adsorbent (a-III) | Fibrous titanium oxide having network structure as a macrostructure (specific surface area by BET method, 400 $m^2/g$) |
| Comparative moisture adsorbent I | Porous silica (specific surface area by BET method, 600 $m^2/g$) |
| Comparative moisture adsorbent II | Silica gel (trade name: Silica gel B, specific surface area by BET method, 450 $m^2/g$, supplied by TOYOTAKAKO Co., Ltd.) |
| Comparative moisture adsorbent III | Particulate titanium oxide (trade name: AEROXIDE $TiO_2$ P25, specific surface area by BET method, 50 $m^2/g$), supplied by Degussa AG) |
| Flame-retarding agent | Finely particulate aluminum hydroxide (trade name: HIGILITE, supplied by SHOWA DENKO K.K.) |

TABLE 2

| | |
|---|---|
| Cellulosic fibrillated fiber (b) | Cellulosic fibrillated fiber (trade name: CELISH KY-100G, supplied by DAICEL CHEMICAL INDUSTRIES, LTD.) |
| Comparative fibrillated fiber | Wholly aromatic polyamide fibrillated fiber (trade name: TIARA, supplied by DAICEL CHEMICAL INDUSTRIES, LTD.) |
| Organic fiber (c) having fineness of 0.01 to 0.45 dtex. | Polyethylene terephthalate fiber (trade name: Tepyrus, supplied by Teijin Fibers, Ltd., 0.11 dtex × 3 mm) |
| Fiber bondable under moisture and heat (d-I) | Ethylene-vinyl alcohol copolymer fiber (trade name: S030, supplied by Kuraray Co., Ltd., fineness 0.08 dtex × fiber length 3 mm) |
| Fiber bondable under moisture and heat (d-II) | Vinyl alcohol fiber (trade name: KURALON VP, VPB105, 1.1 dtex × 3 mm, supplied by Kuraray Co., Ltd.) |
| Organic fiber (e) having fineness of over 0.45 but not more than 2.5 dtex. | Polyethylene terephthalate fiber (trade name: Tepyrus: supplied by Teijin Fibers, Ltd., 1.2 dtex × 3 mm) |
| Thermally fusible organic fiber (f) | Polyester thermally fusible core-shell fiber (trade name: Melty, supplied by UNITIKA, LTD. 0.88 dtex × 3 mm) |
| Inorganic fiber | Glass fiber (trade name: Chopped Glass, fiber diameter 6 μm × fiber length 6 mm, supplied by Asahi Glass Co., Ltd.) |

Examples 1-20, 22 and 24 and Comparative Examples 1-8

Production Examples of Sheet Products

Paper-making slurries (solid content 2 mass %) having components and their amounts as shown in Tables 3-1 and 3-2 were prepared. To each of the thus-obtained slurries was added a coagulating agent (trade name: PERCOL 57, supplied by Ciba Specialty Chemicals) in an amount of 0.2 mass % based on the solid content, and papers were made with a cylinder paper machine to give sheet products containing a moisture adsorbent each. A drying temperature was set at 120° C.

Example 21

Production Example of Sheet Product

A paper-making slurry (solid content 2 mass %) having components and their amounts as shown in Table 3-2 was prepared. To the thus-obtained slurry was added a coagulating agent (trade name: PERCOL 57, supplied by Ciba Specialty Chemicals) in an amount of 0.2 mass % based on the solid content, and paper was make with a combination paper machine (triple cylinder paper machine) to give a sheet product having a basis weight of 150 $g/m^2$ (each layer: 50 $g/m^2$). A drying temperature was set at 120° C.

Examples 23 and 25

Production Examples of Sheet Products

The sheet products obtained in Examples 22 and 9 were impregnated with a vinyl chloride-ethylene copolymer latex (polymer type flame retardant, trade name: Sumielite 1210, supplied by Sumitomo Chemical Co., Ltd.), and the impregnated products were dried at a drying temperature of 120° C. to give sheet products of Examples 23 and 25. The adherence amount of the copolymer was 5 $g/m^2$.

TABLE 3-1

| | Amount (part by mass) | | | | | | | | | | | | | | |
|---|---|---|---|---|---|---|---|---|---|---|---|---|---|---|---|
| | Moisture adsorbent | | | | | | Fibrillated fiber | | Organic fiber Fineness 0.11 dtex | Fiber bondable under moisture and heat | | Organic fiber Fineness 1.2 dtex | Thermally fusible fiber | Inorganic fiber | Flame-retarding agent |
| | Tubular, fibrous | | | Comparative | | | Cellulosic | | | | | | | | |
| | (a-I) | (a-II) | (a-III) | I | II | III | (b) | Comparative | (c) | (d-I) | (d-II) | (e) | (f) | | |
| Ex. 1 | 60 | | | | | | 6 | | 34 | | | | | | |
| Ex. 2 | 60 | | | | | | 6 | | 28 | 6 | | | | | |
| Ex. 3 | 60 | | | | | | 6 | | 28 | | 6 | | | | |
| Ex. 4 | | 60 | | | | | 6 | | 28 | | 6 | | | | |

TABLE 3-1-continued

| | Amount (part by mass) | | | | | | | | | | | | | | |
|---|---|---|---|---|---|---|---|---|---|---|---|---|---|---|---|
| | Moisture adsorbent | | | | | | Fibrillated fiber | | Organic fiber Fineness | Fiber bondable under moisture | | Organic fiber Fineness | Thermally fusible | | Flame- |
| | Tubular, fibrous | | | Comparative | | | Cellulosic | | 0.11 dtex | and heat | | 1.2 dtex | fiber | Inorganic | retarding |
| | (a-I) | (a-II) | (a-III) | I | II | III | (b) | Comparative | (c) | (d-I) | (d-II) | (e) | (f) | fiber | agent |
| Ex. 5 | | | 60 | | | | 6 | | 28 | | 6 | | | | |
| Ex. 6 | 60 | | | | | | 6 | | 20 | | | 14 | | | |
| Ex. 7 | 60 | | | | | | 6 | | 24 | | | | 10 | | |
| Ex. 8 | | 60 | | | | | 6 | | 24 | | | | 10 | | |
| Ex. 9 | | | 60 | | | | 6 | | 24 | | | | 10 | | |
| Ex. 10 | 60 | | | | | | 6 | | 15 | | | 9 | 10 | | |
| Ex. 11 | 60 | | | | | | 6 | | 26 | | 4 | 4 | | | |
| Ex. 12 | 15 | | | | | | 3 | | 76 | | 6 | | | | |
| Ex. 13 | 30 | | | | | | 5 | | 59 | | 6 | | | | |
| Ex. 14 | 45 | | | | | | 6 | | 43 | | 6 | | | | |
| Ex. 15 | 75 | | | | | | 7 | | 12 | | 6 | | | | |
| Ex. 16 | 80 | | | | | | 7 | | 10 | | | 3 | | | |
| Ex. 17 | 90 | | | | | | 3 | | 3 | | 4 | | | | |

Ex. = Example

TABLE 3-2

| | Amount (part by mass) | | | | | | | | | | | | | | |
|---|---|---|---|---|---|---|---|---|---|---|---|---|---|---|---|
| | Moisture adsorbent | | | | | | Fibrillated fiber | | Organic fiber Fineness | Fiber bondable under moisture | | Organic fiber Fineness | Thermally fusible | | Flame- |
| | Tubular, fibrous | | | Comparative | | | Cellulosic | | 0.11 dtex | and heat | | 1.2 dtex | fiber | Inorganic | retarding |
| | (a-I) | (a-II) | (a-III) | I | II | III | (b) | Comparative | (c) | (d-I) | (d-II) | (e) | (f) | fiber | agent |
| Ex. 18 | 15 | | | | | | 3 | | 30 | | | 37 | 15 | | |
| Ex. 19 | 30 | | | | | | 5 | | 30 | | | 20 | 15 | | |
| Ex. 20 | 80 | | | | | | 10 | | 10 | | | | | | |
| Ex. 21 | 80 | | | | | | 10 | | 10 | | | | | | |
| Ex. 22 | 55 | | | | | | 7 | | 15 | | 6 | | | 7 | 10 |
| Ex. 23 | 55 | | | | | | 7 | | 15 | | 6 | | | 7 | 10 |
| Ex. 24 | 30 | | | | | | 7 | | 15 | | 6 | | | 7 | 35 |
| Ex. 25 | | | 60 | | | | 6 | | 24 | | | | 10 | | |
| CEx. 1 | | | | 60 | | | 6 | | 28 | | 6 | | | | |
| CEx. 2 | | | | | 60 | | 6 | | 28 | | 6 | | | | |
| CEx. 3 | | | | | | 60 | 6 | | 28 | | 6 | | | | |
| CEx. 4 | | | | 60 | | | 6 | | 24 | | | | 10 | | |
| CEx. 5 | | | | | 60 | | 6 | | 24 | | | | 10 | | |
| CEx. 6 | | | | | | 60 | 6 | | 24 | | | | 10 | | |
| CEx. 7 | 60 | | | | | | | 6 | 28 | | 6 | | | | |
| CEx. 8 | 60 | | | | | | 6 | | | | 6 | 28 | | | |

Ex. = Example,
CEx. = Comparative Example

The thus-obtained sheets were subjected to the following evaluations according to the following methods. Tables 4-1 and 4-2 shows the results.

<Evaluation 1: Basis Weight>

A sample of 25 cm×25 cm was taken from a sheet product, left in air at 23° C. at a relative humidity of 50% for 4 hours and then measured for a mass. A value obtained by multiplying the measurement value by 16 was taken as a basis weight (sheet product weight per $m^2$).

<Evaluation 2: Yield of Product in Paper Making>

A value expressed by percentage of a mass ratio of a moisture adsorbent held in a sheet product to a mass ratio of a moisture adsorbent added during paper making was taken as a yield of product in paper making. The mass ratio of a moisture adsorbent held in a sheet product was measured by a sintering method or a fluorescence X-ray method.

<Evaluation 3: Tensile Strength>

A sample of 5 cm×25 cm was taken from a sheet product, left in air at 23° C. at a relative humidity for 4 hours and then measured for a breaking strength with a tensile tester (trade name: STA-1150, supplied by ORIENTEC Co., LTD.). The measurement was made at a tension rate of 300 mm/minute.

<Evaluation 4: Measurement of Moisture Absorptivity>

A sample of 25 cm×25 cm was taken from a sheet product, left in air at 23° C. at a relative humidity of 70% for 2 hours and then measured for a mass W1. The sample after the moisture adsorption was dehydrated in a dryer at 85° C. for 2 hours and then promptly measured for a mass W2. A moisture absorptivity was calculated on the basis of the following expression (1).

$$\text{Moisture absorptivity}=(W1-W2)/W2\times 100 \quad (1)$$

<Evaluation 5: Rubbing Test>

Each sheet product was cut in the size of 5 cm×20 cm, and a 5 cm×5 cm weight of 200 g was placed on one end in the long side direction. This sheet product with the weight thereon was dragged on a black paper at a speed of 10 cm/second, the black paper surface was observed for moisture adsorbent that had off and remained on the black paper, and a state thereof was evaluated on the basis of the following ratings.

◎: A state where the moisture adsorbent slightly remained on the black paper.

○: A level on which it was observed that the moisture adsorbent had fallen off, but no problem was posed for use.

Δ: A state where the moisture adsorbent had come off and a fiber had also slightly fallen off.

X: A state where it was observed that both the moisture adsorbent and the fiber had fallen off.

<Evaluation 6: Combustion Test>

The sheet products produced in Examples 9 and 22 to 25 were subjected to a combustion test by a method according to JACA No. 11A-2003. Tables 4-1 and 4-2 shows the classification results of flammability and the states of a flame when a burner was applied.

TABLE 4-1

| | Ev. 1 Basis weight | Evaluation 2 Addition ratio of moisture adsorbent | Evaluation 2 Content of moisture adsorbent in sheet product | Evaluation 2 Yield of paper making | Evaluation 3 Tensile strength | Evaluation 4 Moisture absorptivity | Evaluation 5 | Evaluation 6 Combustion test | |
|---|---|---|---|---|---|---|---|---|---|
| | g/m² | Mass % | g/m² | % | N/m | Mass % | Rubbing test | Class | State of flame |
| Ex. 1 | 90 | 60 | 50.8 | 94 | 2 | 14 | Δ | | |
| Ex. 2 | 90 | 60 | 50.8 | 94 | 4 | 14 | ○ | | |
| Ex. 3 | 90 | 60 | 50.8 | 94 | 4 | 14 | ○ | | |
| Ex. 4 | 90 | 60 | 49.7 | 92 | 4 | 15 | ○ | | |
| Ex. 5 | 90 | 60 | 51.3 | 95 | 4 | 15 | ○ | | |
| Ex. 6 | 90 | 60 | 51.3 | 95 | 2 | 14 | Δ | | |
| Ex. 7 | 90 | 60 | 51.3 | 95 | 5 | 14 | ◎ | | |
| Ex. 8 | 90 | 60 | 49.7 | 92 | 5 | 14 | ◎ | | |
| Ex. 9 | 90 | 60 | 51.3 | 95 | 5 | 15 | ◎ | Total loss | Yes |
| Ex. 10 | 90 | 60 | 50.8 | 94 | 6 | 14 | ◎ | | |
| Ex. 11 | 90 | 60 | 51.3 | 95 | 5 | 14 | ◎ | | |
| Ex. 12 | 90 | 15 | 13.2 | 98 | 12 | 4 | ○ | | |
| Ex. 13 | 90 | 30 | 26.5 | 98 | 12 | 7 | ○ | | |
| Ex. 14 | 90 | 45 | 39.3 | 97 | 4 | 11 | ○ | | |
| Ex. 15 | 90 | 75 | 64.8 | 96 | 2 | 18 | ○ | | |
| Ex. 16 | 50 | 80 | 38.4 | 96 | 1 | 11 | Δ | | |
| Ex. 17 | 50 | 90 | 40.5 | 90 | 2 | 11 | Δ | | |
| Ex. 18 | 150 | 15 | 22.1 | 98 | 12 | 6 | ◎ | | |
| Ex. 19 | 150 | 30 | 44.1 | 98 | 12 | 12 | ◎ | | |

Ev = Evaluation,
Ex. = Example,
CEx. = Comparative Example

TABLE 4-2

| | Ev. 1 Basis weight | Evaluation 2 Addition ratio of moisture adsorbent | Evaluation 2 Content of moisture adsorbent in sheet product | Evaluation 2 Yield of paper making | Evaluation 3 Tensile strength | Evaluation 4 Moisture absorptivity | Evaluation 5 | Evaluation 6 Combustion test | |
|---|---|---|---|---|---|---|---|---|---|
| | g/m² | Mass % | g/m² | % | N/m | Mass % | Rubbing test | Class | State of flame |
| Ex. 20 | 150 | 80 | 99.6 | 83 | 4 | 18 | Δ | | |
| Ex. 21 | 150 | 80 | 117.6 | 98 | 3 | 21 | Δ | | |
| Ex. 22 | 80 | 55 | 41.8 | 95 | 4 | 11 | ◎ | Total loss | No |
| Ex. 23 | 85 | 55 | 41.8 | 95 | 5 | 11 | ◎ | 3 | No |
| Ex. 24 | 80 | 30 | 22.8 | 95 | 4 | 7 | ◎ | 3 | No |
| Ex. 25 | 95 | 60 | 54.2 | 95 | 5 | 15 | ◎ | 3 | No |
| CEx. 1 | 90 | 60 | 45.9 | 85 | 4 | 10 | ○ | | |
| CEx. 2 | 90 | 60 | 44.3 | 82 | 4 | 8 | ○ | | |
| CEx. 3 | 90 | 60 | 48.6 | 90 | 4 | 0.2 | ○ | | |
| CEx. 4 | 90 | 60 | 45.9 | 85 | 4 | 10 | ◎ | | |
| CEx. 5 | 90 | 60 | 44.3 | 82 | 4 | 9 | ◎ | | |
| CEx. 6 | 90 | 60 | 48.6 | 90 | 4 | 0.2 | ◎ | | |

TABLE 4-2-continued

| | Ev. 1 Basis weight | Evaluation 2 Addition ratio of moisture adsorbent | Evaluation 2 Content of moisture adsorbent in sheet product | Evaluation 2 Yield of paper making | Evaluation 3 Tensile strength | Evaluation 4 Moisture absorptivity | Evaluation 5 | Evaluation 6 Combustion test | |
|---|---|---|---|---|---|---|---|---|---|
| | $g/m^2$ | Mass % | $g/m^2$ | % | N/m | Mass % | Rubbing test | Class | State of flame |
| CEx. 7 | 90 | 60 | 21.6 | 40 | 8 | 6 | X | | |
| CEx. 8 | 90 | 60 | 32.4 | 60 | 8 | 7 | ◎ | | |

Ev = Evaluation,
Ex. = Example,
CEx. = Comparative Example

Example 26

Production Example of Article (Filter-Like Article a)

Filter-like articles having air permeability in the length direction and having a cross-sectional area of 36 $cm^2$ (6 cm×6 cm) were produced from the sheet products obtained in Examples 1 to 25 and Comparative Examples 1 to 8 in a manner that each sheet product was subjected to one-side corrugating (1.9 mm high, a pitch of 3.2 mm) and 23 thus-prepared corrugated products were stacked one on another.

The thus-obtained filter-like articles a were subjected to the following evaluations according to the following methods. Table 5 shows the results. The evaluation results are so described as to correspond to the sheet products of Examples 1 to 25 and Comparative Examples 1 to 8 used for the production of the filter-like products a.

<Evaluation 7: Processability>

Processability for the filter-like products a were evaluated on the basis of the following ratings.

◎: Almost no deformation was observed.

○: Deformation was slightly observed.

Δ: Greatly deformed.

X: Corrugation was collapsed, and a filter-like product was greatly deformed.

<Evaluation 8: Moisture Absorption Capability>

Filter-like products having lengths that had been adjusted such that the contents of moisture adsorbents held were equal were placed in glass tubes having an internal diameter of 9 cm. The above length being smaller means that a dehumidifier device and a heat-exchanger device can be downsized.

Then, hot air having a temperature of 40° C. and a relative humidity of 45% was introduced into the glass tubes to bring the filter-like products a into an initial dehydration state. Then, air (25° C., relative humidity 100%) that had caused to pass through water at 25° C. and that had a saturated moisture content was caused to flow into one end of each at a flow rate of 200 ml/second, and while air flowing out of the glass rubes were maintained at 25° C., time periods before the relative humidity of air on the discharge side exceeded 60% were measured. This time period being longer means that the capability of moisture absorption is high.

<Evaluation 9: Capability of Moisture Release>

Filter-like products having lengths that had been adjusted such that the contents of moisture adsorbents held were equal like Evaluation 8 were placed in glass tubes having an internal diameter of 9 cm. Air having a temperature of 25° C. and a relative humidity of 100% was introduced at a flow rate of 200 ml/second for 10 minutes to bring them into an initial moisture absorption state. Then, hot air at 40° C. and a relative humidity of 45% was caused to flow in at a flow rate of 200 ml/second, and while air that flowed out of the glass tubes was maintained at 45° C., the air was measured for a relative humidity at the initial stage of the air flowing out. The relative humidity at the initial stage of air flowing out being higher means that a filter-like product has the capability of promptly releasing moisture.

Example 27

Production Example of Article (Filter-Like Article b)

Filter-like articles b having a diameter of 10 cm and a length of 20 cm were produced from the sheet products obtained in Examples 1 to 25 and Comparative Examples 1 to 8 in a manner that each sheet product was subjected to one-side corrugating (1.9 mm high, a pitch of 3.2 mm) and each corrugated product was slit in a width of 20 cm followed by rolling up in the form of a cylinder. Each of the thus-obtained filter-like articles b was subjected to the following evaluations according to the following methods. Table 5 shows the results. The evaluation results are so described as to correspond to the sheet products of Examples 1 to 25 and Comparative Examples 1 to 8 used for the production of the filter-like products a.

<Evaluation 10: Moisture Absorption Capability>

FIG. 1 shows a schematic cross-sectional view of a moisture absorption-release measuring apparatus used for this evaluation. In FIG. 1, on the upstream side of a stainless steel tube 1 (inner diameter: 12 cm, length: 20 cm) packed with a filter-like substance b, a stainless steel tube 2 (inner diameter: 12 cm, length: 30 cm) is attached through an on-off valve 6. On the downstream side, further, a stainless steel tube 3 (inner diameter: 12 cm, length: 30 cm) is attached through an on-off valve 7. Temperature and relative humidity meters 4 and 5 are inserted into the stainless steel tubes 2 and 3 to ensure that the temperatures and relative humidity of air (upstream side) and air (downstream side) are measurable.

First, the moisture absorption-release measuring apparatus is placed in a variable constant-temperature constant humidity chamber that is adjusted to 30° C. and a relative humidity 80% (absolute water content: 24.3 g). The on-off values 6 and 7 are opened, and hot air prepared by adjusting this air to 80° C. is caused to flow in from the stainless steel tube 2 so as to attain an air quantity of 2 m/second on the downstream side. The hot air is caused to flow in until the absolute water content obtained from temperature and humidity degrees measured with the temperature and humidity meter 5 becomes 24.3±0.1 g, to bring a filter-like article b into an initial dry state. Then, the flowing of the hot air is stopped, the on-off valves 6 and 7 are closed, the apparatus is allowed to stand for 30 minutes, and the temperature of the filter-like article b is decreased to 30° C. Thereafter, the on-off values 6 and 7 are opened to cause air having 30° C. and a relative humidity of 80% to flow in from the stainless steel tube 2 so as to attain an air quantity of 2 m/second on the downstream side, and a time period until the absolute water content obtained from temperature and humidity degrees measured with the temperature and humidity meter 5 becomes 24.3±0.1 g was measured. This time period was used as a 80° C. adsorption equilibrium time period.

Each of 60° C. adsorption equilibrium time period and 50° C. adsorption equilibrium time period was measured in the same manner as in the measurement of the 80° C. adsorption equilibrium time period except that the temperature of air when the initial dry state was brought was changed to 60° C. and 50° C. In addition, the adsorption equilibrium time period being long means that the amount of moisture released when the initial dry state is brought is large.

<Evaluation 11: Test of Powder Falling Off>

A filter-like article b was allowed to stand in a constant-temperature constant-humidity chamber having 23° C. and a relative humidity of 50% for 4 hours, and measured for a mass. The moisture absorption-release measuring apparatus shown in FIG. 1 was charged with the filter-like article b, and in a state that the on-off valves 6 and 7 were open, the apparatus was allowed to stand in a constant-temperature constant-humidity chamber having 23° C. and a relative humidity of 50% for 4 hours. Then, hot air prepared by adjusting the air in the constant-temperature constant-humidity chamber to 80° C. was caused to flow in so as to attain a face air flow rate of 10 m/second on the downstream side. The hot air was caused to continuously flow in for 24 hours. The filter-like article was measured for a change in mass between that before the test and that after the test, and Table 5 shows the results.

TABLE 5

| | | Ev. 8 | | | Ev. 10 | | | Ev. 11 |
|---|---|---|---|---|---|---|---|---|
| | Ev. 7 Processability | Length of filter-like article cm | MAC Sec. | Ev. 9 MRC % | 80° C. ad. eq. time period Min. | 60° C. ad. eq. time period Min. | 50° C. ad. eq. time period Min. | Test of powder falling off % |
| Ex. 1 | Δ | 8 | 40 | 55 | 10 | 5 | 3 | 100 |
| Ex. 2 | ○ | 8 | 40 | 55 | 10 | 5 | 3 | 100 |
| Ex. 3 | ○ | 8 | 40 | 55 | 10 | 5 | 3 | 100 |
| Ex. 4 | ○ | 8 | 40 | 55 | 10 | 5 | 3 | 100 |
| Ex. 5 | ○ | 8 | 40 | 55 | 10 | 5 | 3 | 100 |
| Ex. 6 | ○ | 8 | 40 | 55 | 10 | 5 | 3 | 100 |
| Ex. 7 | ◎ | 8 | 40 | 55 | 10 | 5 | 3 | 100 |
| Ex. 8 | ◎ | 8 | 40 | 55 | 10 | 5 | 3 | 100 |
| Ex. 9 | ◎ | 8 | 40 | 55 | 10 | 5 | 3 | 100 |
| Ex. 10 | ◎ | 8 | 40 | 55 | 10 | 5 | 3 | 100 |
| Ex. 11 | ◎ | 8 | 40 | 55 | 10 | 5 | 3 | 100 |
| Ex. 12 | ○ | 31 | 35 | 55 | 3 | 2 | 1 | 100 |
| Ex. 13 | ○ | 15 | 35 | 55 | 5 | 3 | 1 | 100 |
| Ex. 14 | ○ | 10 | 40 | 55 | 7 | 4 | 2.5 | 100 |
| Ex. 15 | ○ | 6 | 40 | 55 | 13 | 7 | 4 | 100 |
| Ex. 16 | ○ | 11 | 40 | 55 | 7 | 4 | 2.5 | 100 |
| Ex. 17 | ○ | 11 | 40 | 55 | 7 | 4 | 2.5 | 100 |
| Ex. 18 | ◎ | 19 | 40 | 55 | 5 | 2 | 1 | 100 |
| Ex. 19 | ◎ | 9 | 40 | 55 | 8 | 4 | 2 | 100 |
| Ex. 20 | Δ | 5 | 40 | 55 | 20 | 9 | 4 | 100 |
| Ex. 21 | Δ | 4 | 40 | 55 | 23 | 10 | 5 | 100 |
| Ex. 22 | ○ | 10 | 40 | 55 | 9 | 5 | 3 | 100 |
| Ex. 23 | ◎ | 10 | 40 | 55 | 9 | 5 | 3 | 100 |
| Ex. 24 | ◎ | 15 | 40 | 55 | 5 | 3 | 1 | 100 |
| Ex. 25 | ○ | 8 | 40 | 55 | 10 | 5 | 3 | 100 |
| CEx. 1 | ○ | 8 | 10 | 50 | 2 | 1 | 0.5 | 100 |
| CEx. 2 | ○ | 9 | 8 | 50 | 2 | NC | NC | 100 |
| CEx. 3 | ○ | 8 | NM | 45 | NC | NC | NC | 100 |
| CEx. 4 | ◎ | 9 | 6 | 50 | 2 | 1 | 0.5 | 100 |
| CEx. 5 | ◎ | 9 | 10 | 50 | 2 | NC | NC | 100 |
| CEx. 6 | ◎ | 10 | NM | 45 | NC | NC | NC | 100 |
| CEx. 7 | X | 20 | 25 | 50 | 3 | 2 | 1 | 80 |
| CEx. 8 | Δ | 13 | 25 | 50 | 4 | 2 | 1 | 85 |

EV = Evaluation,
MAC = Moisture absorption capability,
MRC = moisture release capability,
ad. eq. time period = adsorption equilibrium time period,
Sec. = Second,
Min. = Minute,
NM = Non-measurable,
NC = no change,
Ex. = Example,
CEx. = Comparative Example As shown in Tables 3-1 and 3-2, the sheet products obtained in Examples 1 to 25 contained at least the moisture adsorbent as a component (a), the cellulosic fibrillated fiber as a component (b) and the organic fiber having a fineness of 0.01 dtex or more but not more than 0.45 dtex as a component (c). As shown in Tables 4-1, 4-2 and 5, The sheet products obtained in Examples 1 to 25 and the filter-like articles obtained by processing these sheet products were excellent in moisture absorption amount, had dehumidifying capability and moisture release capability, had high yields of moisture adsorbent in paper making and kept a powder from easily falling off.

As shown in Tables 3-1 and 3-2, the sheet products of Examples 3 to 5 and the sheet products of Comparative Examples 1 to 3 contained different moisture adsorbents but had corresponding components, content ratios thereof, etc., respectively. As shown in Tables 4-1, 4-2 and 5, however, the sheet products containing the moisture adsorbents that came under the component (a) in Examples 3 to 5 and the filter-like articles formed of these sheet products were excellent over the sheet products containing the porous silica, silica gel and particulate titanium oxide, respectively, in Comparative Examples 1 to 3 and the filter-like articles formed of these sheet products in yield of product in paper making (Evaluation 2), capability of moisture absorption and release (Evaluations 4, 8 and 9) and capability of regeneration at low temperature (Evaluations 9 and 10). Further, as shown in Tables 3-1 and 3-2, the sheet products of Examples 7 to 9 and the sheet products of Comparative Examples 4 to 6 contained different moisture adsorbents but had corresponding components, content ratios thereof, etc., respectively. As shown in Tables 4-1, 4-2 and 5, however, the sheet products containing the moisture adsorbents that came under the component (a) in Examples 7 to 9 and the filter-like articles formed of these sheet products were excellent over the sheet products containing the porous silica, silica gel and particulate titanium oxide, respectively, in Comparative Examples 4 to 6 and the filter-like articles formed of these sheet products in yield of product in paper making (Evaluation 2), capability of moisture absorption and release (Evaluations 4, 8 and 9) and capability of regeneration at low temperature (Evaluations 9 and 10).

Further, as shown in Tables 3-1 and 3-2, the sheet product of Example 3 and the sheet product of Comparative Example 7 had corresponding components, content ratios thereof, etc., except for the kind of fibrillated fiber. As shown in Tables 4-1, 4-2 and 5, however, the sheet product containing the cellulosic fibrillated fiber coming under the component (b) in Example 3 and the filter-like article formed of this sheet product were excellent over the sheet product containing the wholly aromatic polyamide-containing fibrillated fiber as a comparative fibrillated fiber in Comparative Example 7 and the filter-like article formed of this sheet product in the yield of product in paper making (Evaluation 2), the capability of moisture absorption and release (Evaluations 4, 8 and 9), the rubbing test (Evaluation 5) and the processability (Evaluation 7), and the amount of a powder falling off the sheet product of Example 3 (Evaluation 11) was smaller.

Further, as shown in Tables 3-1 and 3-2, the sheet product of Example 3 and the sheet product of Comparative Example 8 had corresponding components, content ratios thereof, etc., except for the fineness of organic fiber. As shown in Tables 4-1, 4-2 and 5, however, the sheet product containing the organic fiber having a fineness of 0.11 dtex as a component (c) in Example 3 and the filter-like article formed of this sheet product had a high yield of product in paper making (Evaluation 2) and high capability of moisture absorption and release (Evaluations 4, 8 and 9) and the amount of a powder falling off the sheet product was small (Evaluation 11) as compared with the sheet product of Comparative Example 7 and the filter-like article formed of this sheet product.

When the sheet products further containing the fiber bondable under moisture and heat as a component (d) in Examples 2 and 3 and the filter-like article formed of this sheet product are compared with the sheet product containing no component (d) in Example 1 and the filter-like article formed of this sheet product, the sheet products of Examples 2 and 3 and the filter-like article formed of these sheet products had high tensile strength (Evaluation 3) and exhibited excellent results in the rubbing test (Evaluation 5) and the processability (Evaluation 7) as shown in Tables 4-1, 4-2 and 5.

Further, when the sheet product further containing, as a component (e), the organic fiber having a fineness of over 0.45 dtex but not more than 2.5 dtex in Example 6 and the filter-like article formed of this sheet product are compared with the sheet product containing no component (e) in Example 1 and the filter-like article formed of this sheet product, the sheet product of Example 6 was improved in flexibility and excellent in the processability (Evaluation 7) as shown in Tables 4-1, 4-2 and 5.

The sheet products further containing, as a component (f), the thermally fusible organic fiber having a fineness of over 0.45 dtex but not more than 2.5 dtex in Examples 7 to 10 and the filter-like articles formed of these sheet products exhibited excellent results in the tensile strength (Evaluation 3), the rubbing test (Evaluation 5) and the processability (Evaluation 7) as compared with the sheet products containing no component (f) in Examples 1 to 6 and the filter-like articles formed of these sheet products.

The sheet product containing the fiber bondable under moisture and heat as a component (d) and the organic fiber having a fineness of over 0.45 dtex but not more than 2.5 dtex as a component (e), obtained in Example 11, and the filter-like article formed of this sheet product exhibited excellent results in the tensile strength (Exaluation 3), the rubbing test (Evaluation 5) and the processability (Evaluation 7) as compared with the sheet product containing the fiber bondable under moisture and heat as a component (d) but containing no organic fiber as a component (e), obtained in Example 3, and the filter-like article formed of this sheet product, even if the content of the fiber bondable under moisture and heat was small. This is considered to be owing to the interaction between the fiber bondable under moisture and heat as a component (d) and the cellulosic fibrillated fiber as a component (b) and the three-dimensional network formed by the organic fiber having a fineness of over 0.45 dtex but not more than 2.5 dtex as a component (e) and the organic fiber having a fineness of 0.01 to 0.45 dtex as a component (c).

As shown in Tables 3-1, 3-2 and 5, it is seen that the sheet products of Examples 12 to 20 and the filter-like articles formed of these sheet products are improved in the capability of moisture absorption and release (Evaluations 8 to 10) when the content of the moisture adsorbents as a component (a) is increased.

When Example 20 and Example 21 are compared, it is seen that when the mass ratio of the moisture adsorbent in paper making was increased to be high as high as 80 mass % to produce the sheet product having a basis weight of 150 g/m$^2$, the sheet product having a three-layer structure, produced with a combination paper making machine in Example 21, was excellent in formation and had a high yield in paper making (Evaluation 2).

When the combustion test was carried out, the sheet product of Example 9 flamed up to be totally destroyed, since all the components other than the moisture adsorbent as a component (a) were organic components. In contrast, the sheet product of Example 22 was totally destroyed but burned along the sheet surface without flaming up, since 10 mass % of the flame-retarding agent was incorporated in the paper-making. The sheet product of Example 24 containing the flame-retarding agent incorporated in an amount of 35 mass % in the paper-making had a flame retardancy of class 3 and did not flame up. However, the flame-retarding agent was incorporated for stabilizing the paper-making step, and it was required to reduce the content of the moisture adsorbent to the extent of the incorporation. In Examples 23 and 25, their flame retardancy was class 3, and not any flame occurred owing to the effect of the polymer type flame retardant. Further, it was not required to reduce the content of the moisture adsorbent, either.

INDUSTRIAL UTILITY

The sheet product and the article of this invention can be used for packaging materials, dehumidifying sheets, interior finishing materials, filters, moisture conditioning devices, heat-exchanger devices, and the like.

The invention claimed is:

1. A sheet product comprising (a) a moisture adsorbent formed of a tubular or fibrous metal oxide, (b) a cellulosic fibrillated fiber, and (c) an organic fiber having a fineness of 0.01 dtex to 0.45 dtex.

2. The sheet product as recited in claim 1, which further comprises (d) a fiber bondable under moisture and heat.

3. The sheet product as recited in claim 2, wherein the component (d) is an ethylene-vinyl alcohol copolymer fiber or a polyvinyl-alcohol-based fiber.

4. The sheet product as recited in claim 1, which further comprises (e) an organic fiber having a fineness of over 0.45 dtex but not more than 2.5 dtex.

5. The sheet product as recited in claim 1, which further comprises (f) a thermally fusible organic fiber having a fineness of over 0.45 dtex but not more than 2.5 dtex.

6. The sheet product as recited in claim 1, wherein the content of the component (a) based on the sheet product is 30 mass % to 90 mass %.

7. The sheet product as recited in claim 1, which is produced by a paper-making method.

8. The sheet product as recited in claim 2, wherein the content of the component (a) based on the sheet product is 30 mass % to 90 mass %.

9. The sheet product as recited in claim 3, wherein the content of the component (a) based on the sheet product is 30 mass % to 90 mass %.

10. The sheet product as recited in claim 4, wherein the content of the component (a) based on the sheet product is 30 mass % to 90 mass %.

11. The sheet product as recited in claim 5, wherein the content of the component (a) based on the sheet product is 30 mass % to 90 mass %.

12. The sheet product as recited in claim 2, which is produced by a paper-making method.

13. The sheet product as recited in claim 3, which is produced by a paper-making method.

14. The sheet product as recited in claim 4, which is produced by a paper-making method.

15. The sheet product as recited in claim 5, which is produced by a paper-making method.

16. The sheet product as recited in claim 6, which is produced by a paper-making method.

* * * * *